US011000131B2

(12) United States Patent
Cheng

(10) Patent No.: US 11,000,131 B2
(45) Date of Patent: May 11, 2021

(54) GAME FURNITURE

(71) Applicant: JIN SUN GEE PLASTICS CO., LTD., Tainan (TW)

(72) Inventor: Chung-Jen Cheng, Tainan (TW)

(73) Assignee: Jin Sun Gee Plastics Co., Ltd., Tainan (TW)

( * ) Notice: Subject to any disclaimer, the term of this patent is extended or adjusted under 35 U.S.C. 154(b) by 0 days.

(21) Appl. No.: 16/654,199

(22) Filed: Oct. 16, 2019

(65) Prior Publication Data

US 2020/0121095 A1 Apr. 23, 2020

(30) Foreign Application Priority Data

Oct. 18, 2018 (TW) ..... 107214061

(51) Int. Cl.
*A47D 13/10* (2006.01)
*A47D 3/00* (2006.01)

(52) U.S. Cl.
CPC ..... *A47D 13/107* (2013.01); *A47D 3/001* (2017.05)

(58) Field of Classification Search
CPC ... A47D 1/02; A47D 1/04; A47D 1/10; A47D 1/103; A47D 1/106; A47D 3/00; A47D 3/001; A47D 3/005; A47D 11/00; A47D 11/002; A47D 13/04; A47D 13/043; A47D 13/107; A47D 15/006; A47D 15/008
USPC ..... 446/69, 71, 75, 77
See application file for complete search history.

(56) References Cited

U.S. PATENT DOCUMENTS 5,688,211 A * 11/1997 Myers ..... A47D 13/107 297/5
6,000,750 A * 12/1999 Rossman ..... A47D 1/004 108/11
6,964,595 B2 * 11/2005 Libretti ..... A47D 1/10 446/482
7,510,238 B2 * 3/2009 McClintock ..... A47D 3/00 297/137
7,523,984 B2 * 4/2009 Steininger ..... A47D 3/001 297/16.1
7,740,560 B2 * 6/2010 Tadin ..... A47D 13/107 482/27
7,883,143 B2 * 2/2011 Reynolds ..... A47D 1/02 297/45
8,677,533 B2 * 3/2014 Barron ..... A47D 5/00 5/655
8,944,514 B2 * 2/2015 Tadin ..... A47D 3/001 297/440.11
10,342,361 B2 * 7/2019 Cotirla ..... A47D 15/00
10,456,701 B2 * 10/2019 Healy ..... A63H 33/006
10,463,171 B2 * 11/2019 Healy ..... A47D 1/004
(Continued)

*Primary Examiner* — Joseph B Baldori
(74) *Attorney, Agent, or Firm* — Rosenberg, Klein & Lee

(57) ABSTRACT

A game furniture is disclosed herein. It comprises a game table having a table board, a plurality of table legs fixedly connected at a bottom of the table board and a through hole at a center of the table board for accommodating a user; and a seat having a chair plate unit and a plurality of chair legs pivotally connected to the chair plate unit, wherein the plurality of chair legs are respectively engaged with the plurality of table legs when the plurality of chair legs are spread out to parallel to the chair plate unit to decrease a height of the chair plate unit, and wherein the seat is separated from the game table for use when the plurality of chair legs are erected perpendicular to the chair plate unit.

10 Claims, 11 Drawing Sheets

(56) References Cited

U.S. PATENT DOCUMENTS

| | | | | |
|---|---|---|---|---|
| 10,736,437 | B2 * | 8/2020 | Goh | A47D 1/02 |
| 2002/0164917 | A1 * | 11/2002 | Keegan | A47D 13/107 446/71 |
| 2008/0303322 | A1 * | 12/2008 | Young | A47D 1/02 297/217.1 |
| 2010/0252589 | A1 * | 10/2010 | Popescu | A45F 4/02 224/155 |

* cited by examiner

GAME FURNITURE

BACKGROUND OF THE INVENTION

1. Field of the Invention

The present invention relates to provide a game furniture for infants and toddlers.

2. Description of Related Art

People usually prepare a game seat that can be placed in the home activity space for their newborn babies to restraint babies in a specific range and ensure that adults can look after babies while doing other activities. However, conventional game seats are only suitable for babies, not for toddlers. Therefore, the above-mentioned game seats with only one function can only be used for a short period of time.

SUMMARY OF THE INVENTION

In view of the above-mentioned problems, the object of the present invention is to provide a game furniture for infants and toddlers.

The game furniture mainly comprises a game table and a seat. The game table is provided with a table board, a plurality of table legs fixedly connected at a bottom of the table board and a through hole at a center of the table board for accommodating a user. The seat is provided with a chair plate unit and a plurality of chair legs pivotally connected to the chair plate unit.

The plurality of chair legs are respectively engaged with the plurality of table legs when the plurality of chair legs are spread out to parallel to the chair plate unit to decrease a height of the chair plate unit, and the seat is separated from the game table for use when the plurality of chair legs are erected perpendicular to the chair plate unit.

Accordingly, the game furniture of the present invention can be used as a child seat for accommodating infants and toddlers in the through hole when the plurality of chair legs are spread out to parallel to the chair plate unit and respectively engaged with the plurality of table legs. Furthermore, the plurality of chair legs can be detached from the game table to form a separate table and chairs for use, so the present invention has multiple functions in use.

BRIEF DESCRIPTION OF THE DRAWINGS

The structure and the technical means adopted by the present invention can be best understood by referring to the following detailed description of the preferred embodiments and the accompanying drawings, wherein.

DETAILED DESCRIPTION OF THE PREFERRED EMBODIMENT

Hereinafter, an exemplary embodiment of the present invention will be described in detail with reference to the accompanying drawings.

Figure 1:
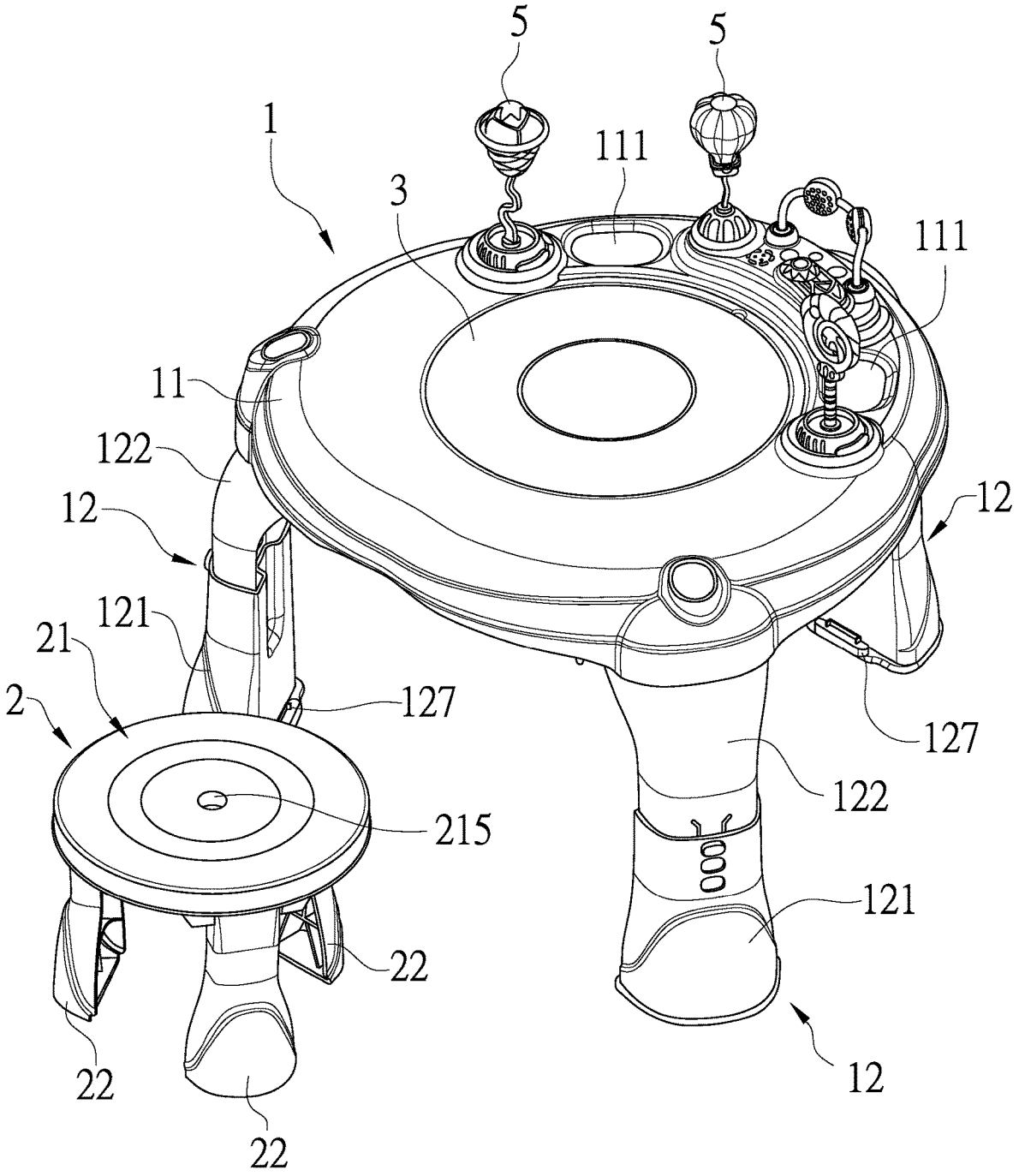
FIG. 1 is a stereogram showing a game furniture according to the present invention.
Figure 2:
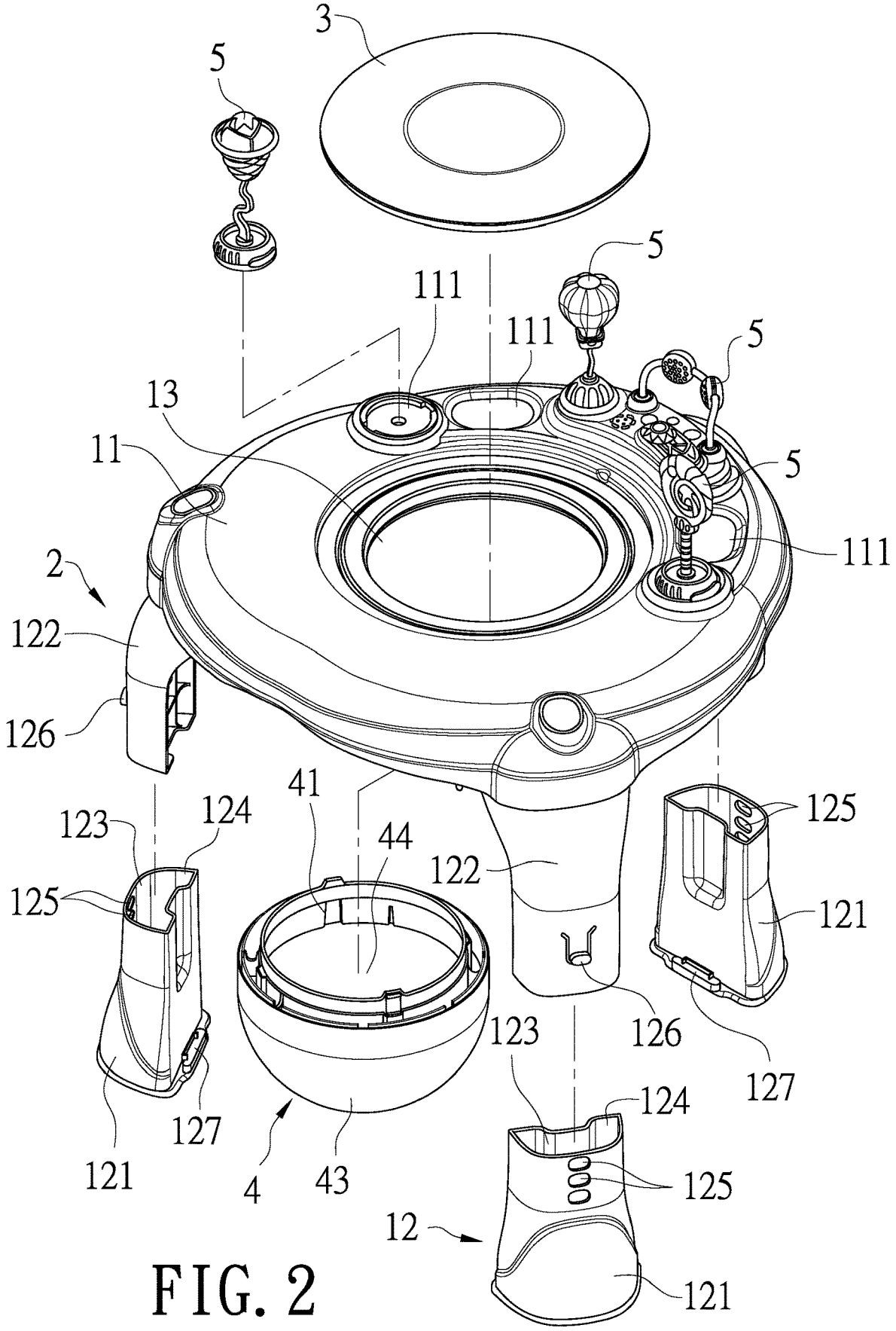
FIG. 2 is a partial explosion diagram showing a game furniture according to the present invention.
Figure 3:
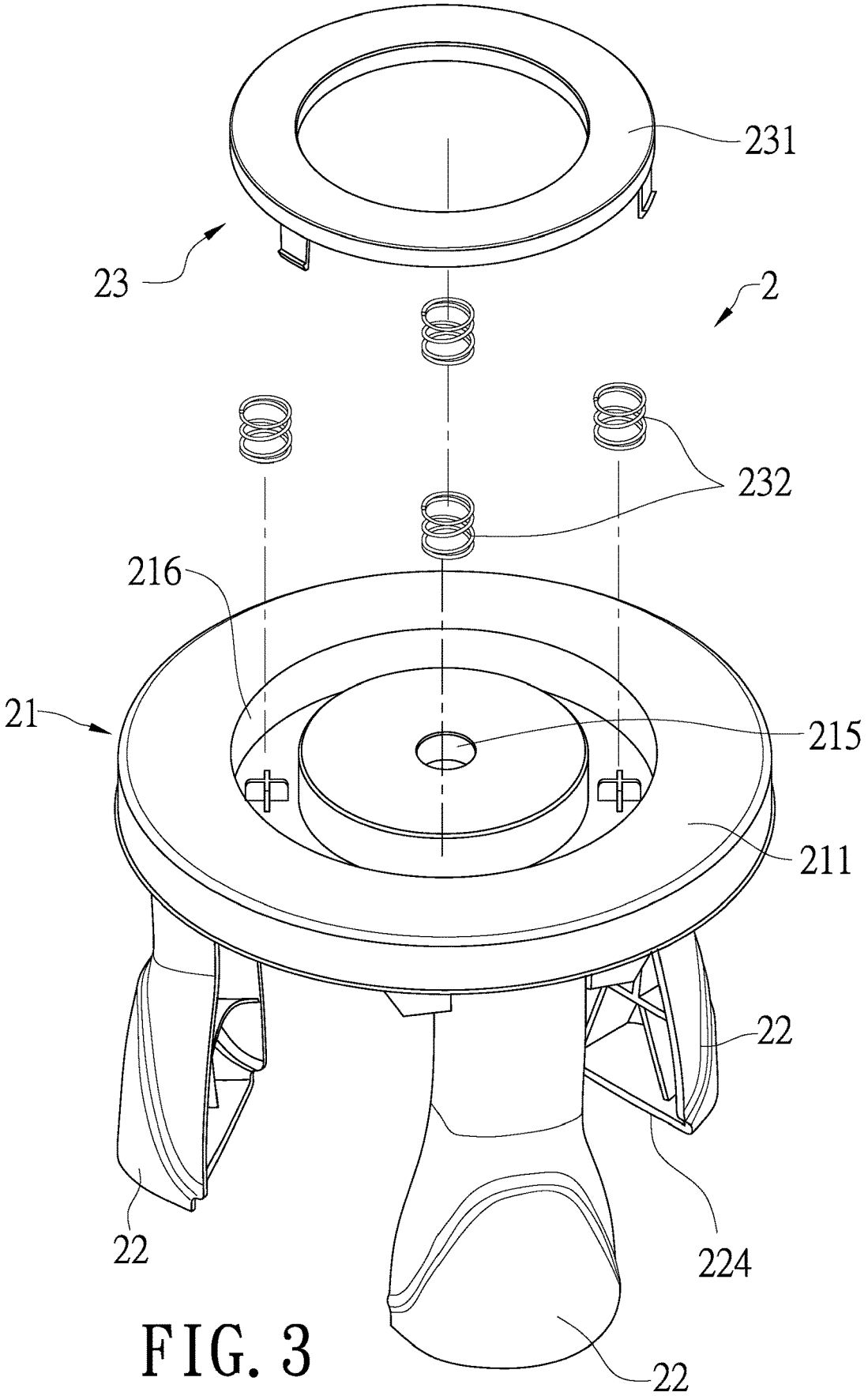
FIG. 3 is a partial explosion diagram showing an elastic device disposed on a chair plate unit of a seat according to the present invention.
Figure 4:
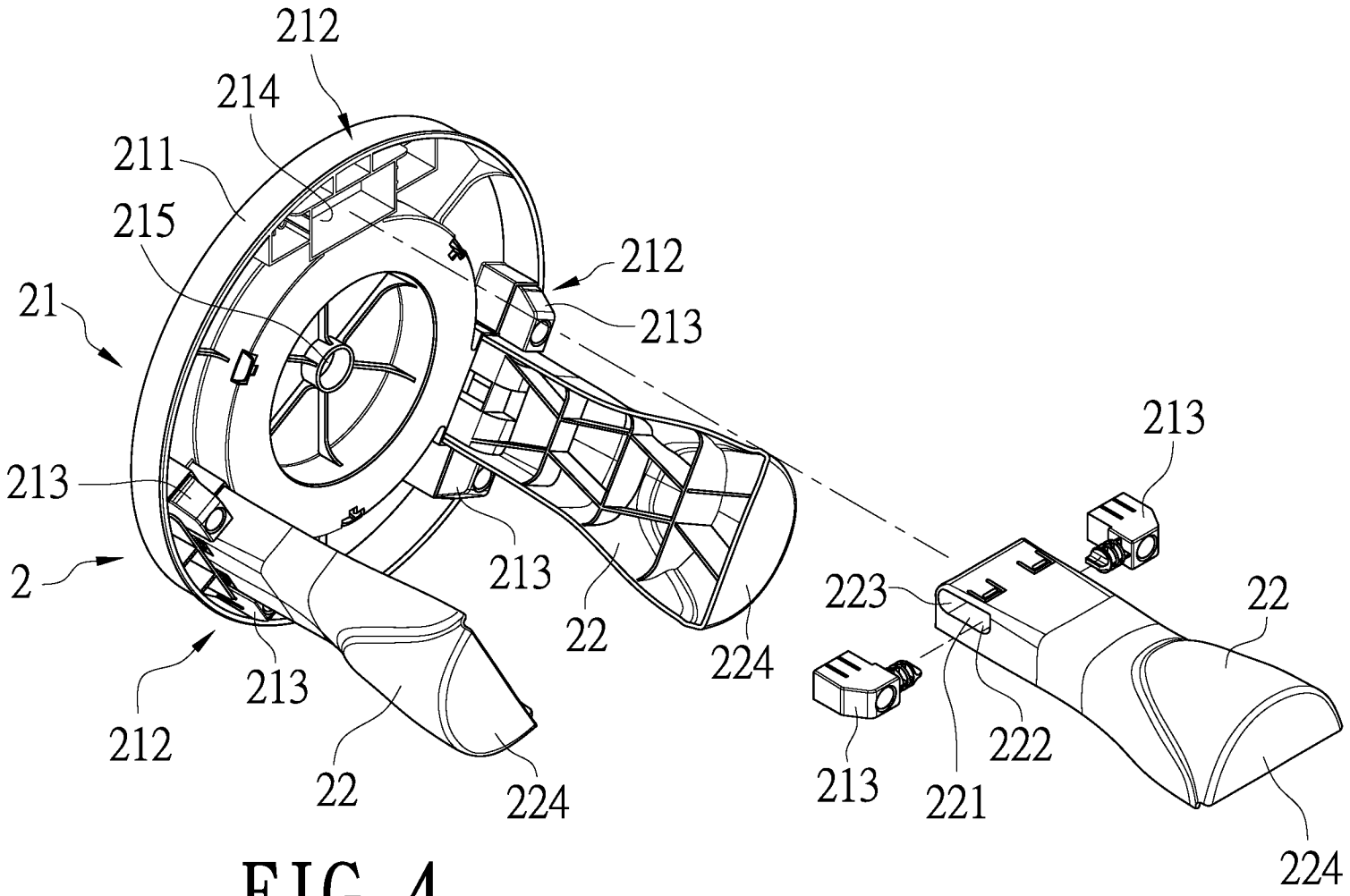
FIG. 4 is a partial stereogram showing a chair plate unit and a plurality of chair legs according to the present invention.
Figure 5:
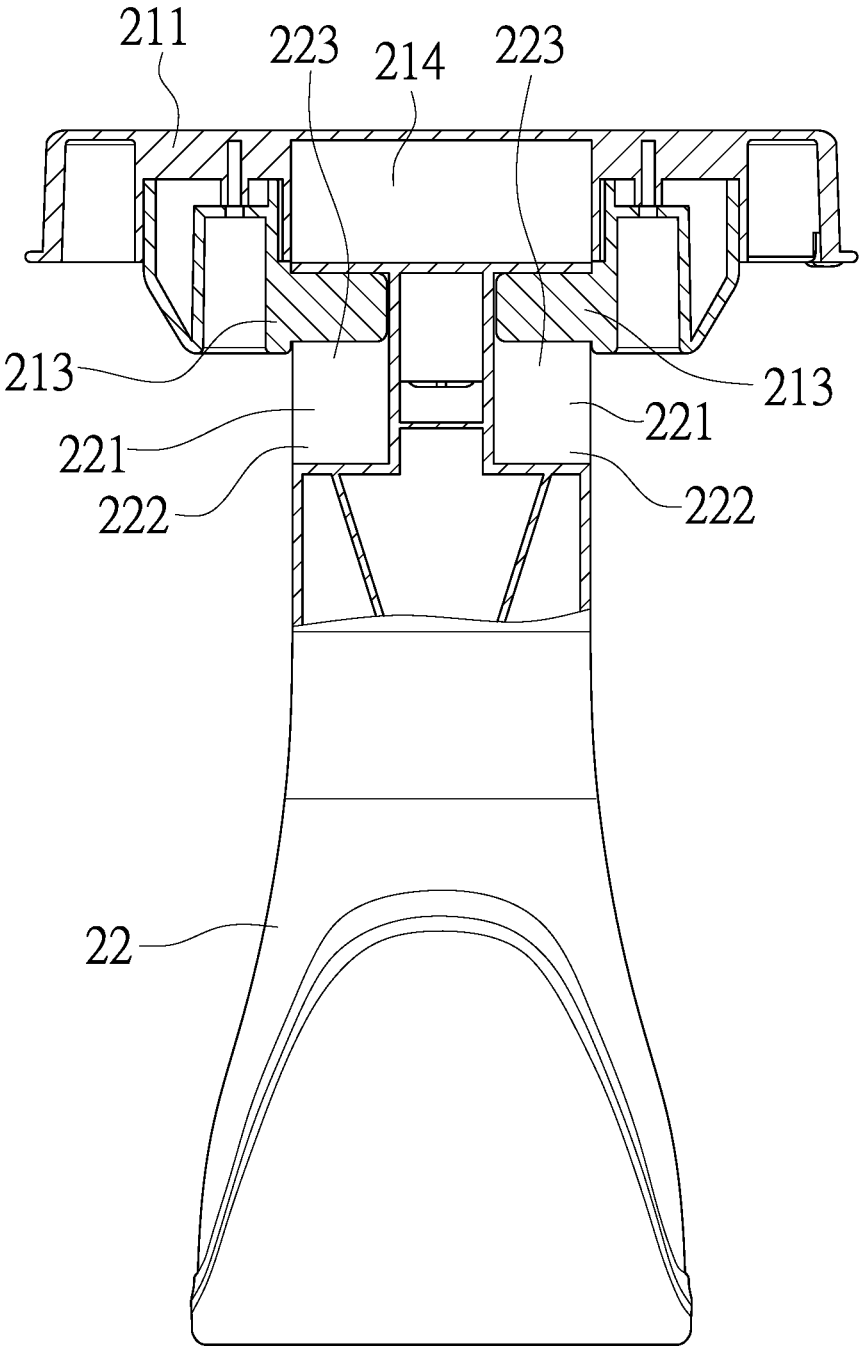
FIG. 5 is a cross-sectional view showing a chair leg pivotally connected to the chair plate unit and at an erected state.
Figure 6:
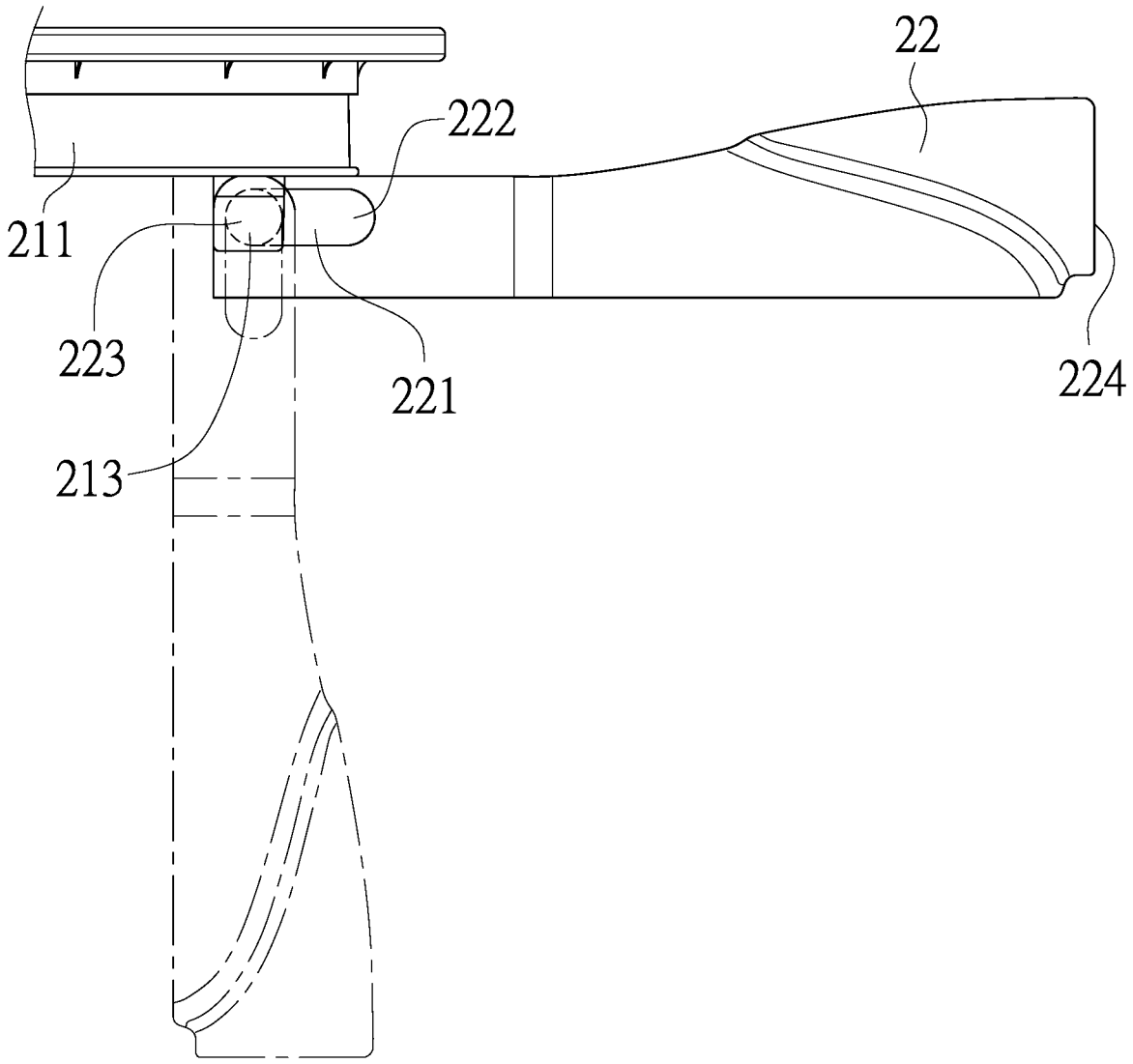
FIG. 6 is a schematic diagram showing a chair leg pivotally moved relative to the chair plate unit for perpendicular or parallel to the chair plate unit.
Figure 7:
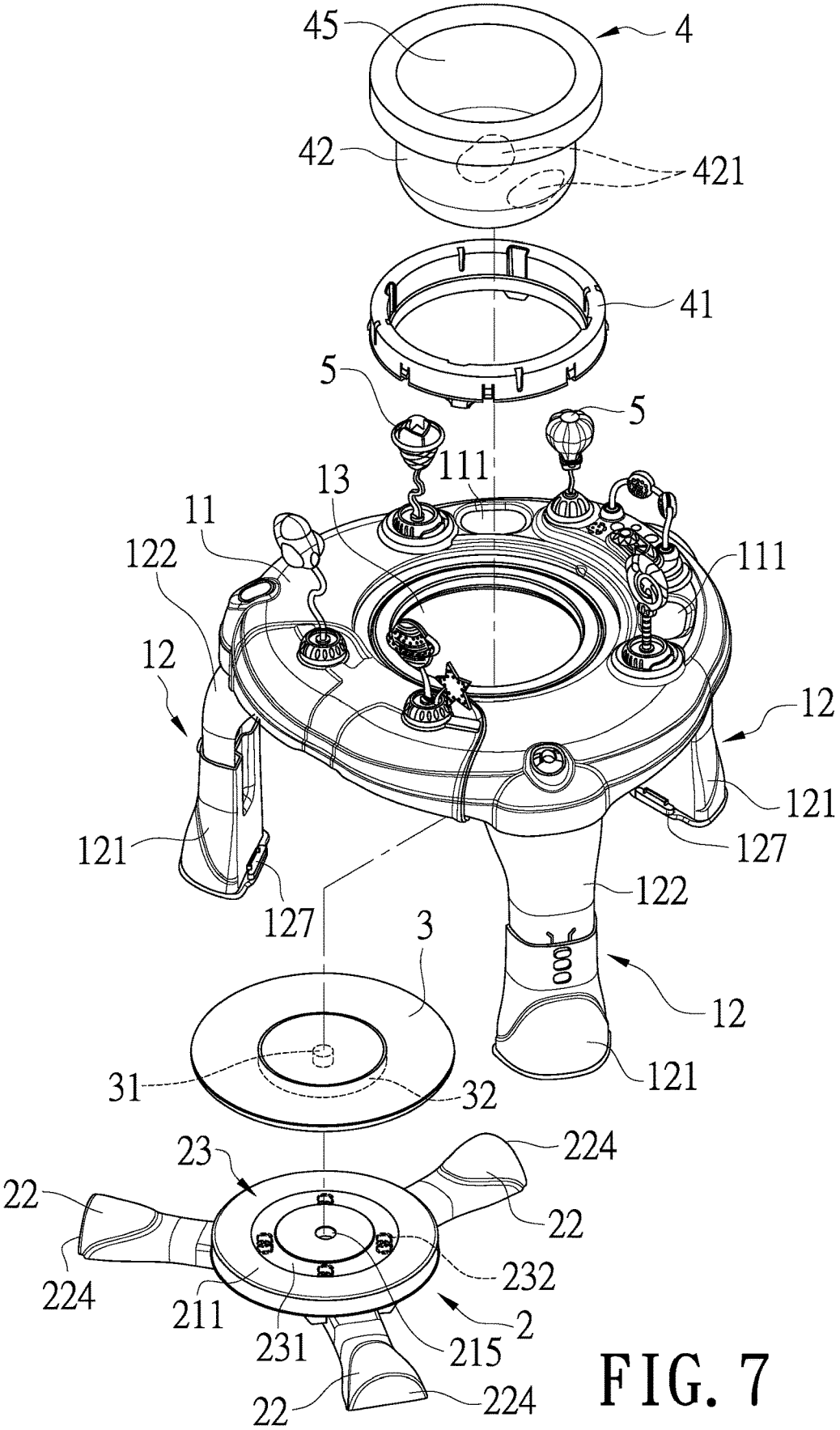
FIG. 7 is a schematic diagram showing a plurality of chair legs of a seat at a spread out state for assembling to a game table.
Figure 8:
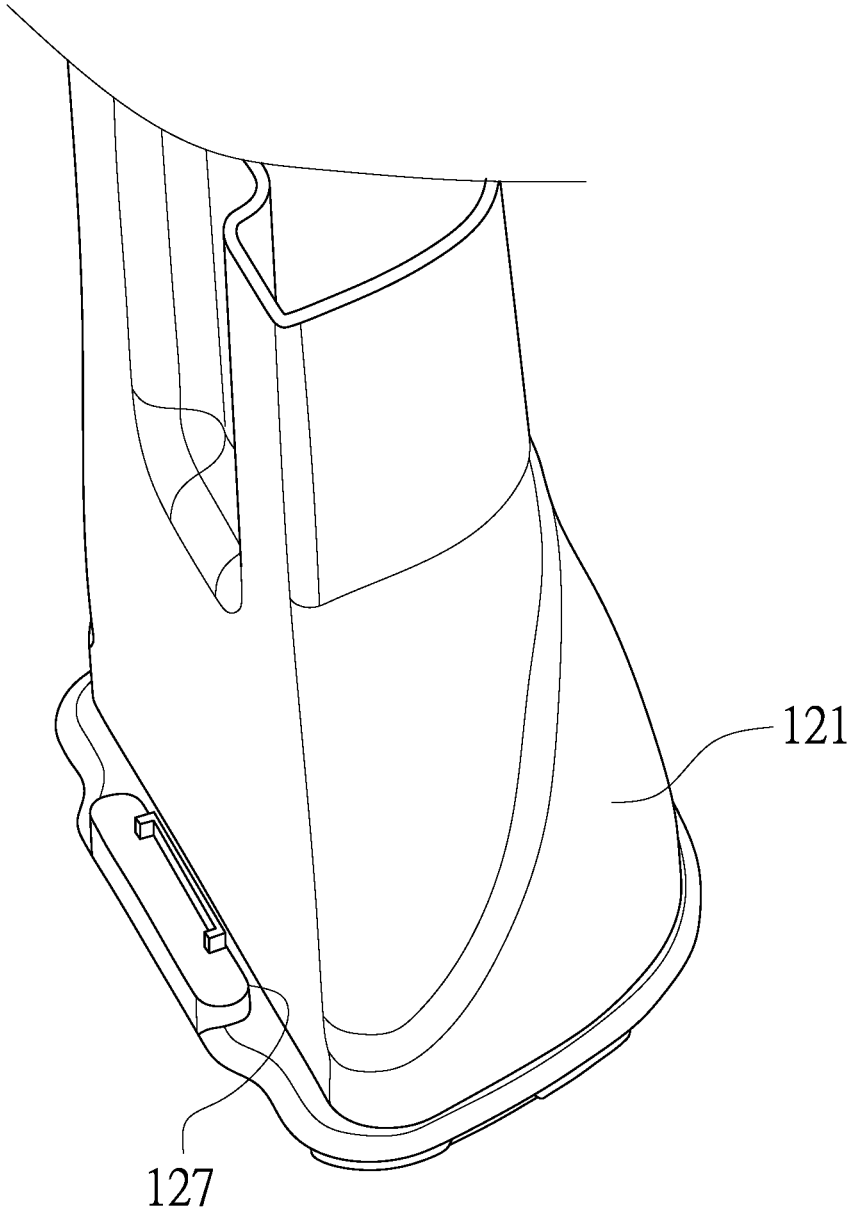
FIG. 8 is a partial enlarged diagram showing a table leg having a lower part and an engaging slot.
Figure 9:
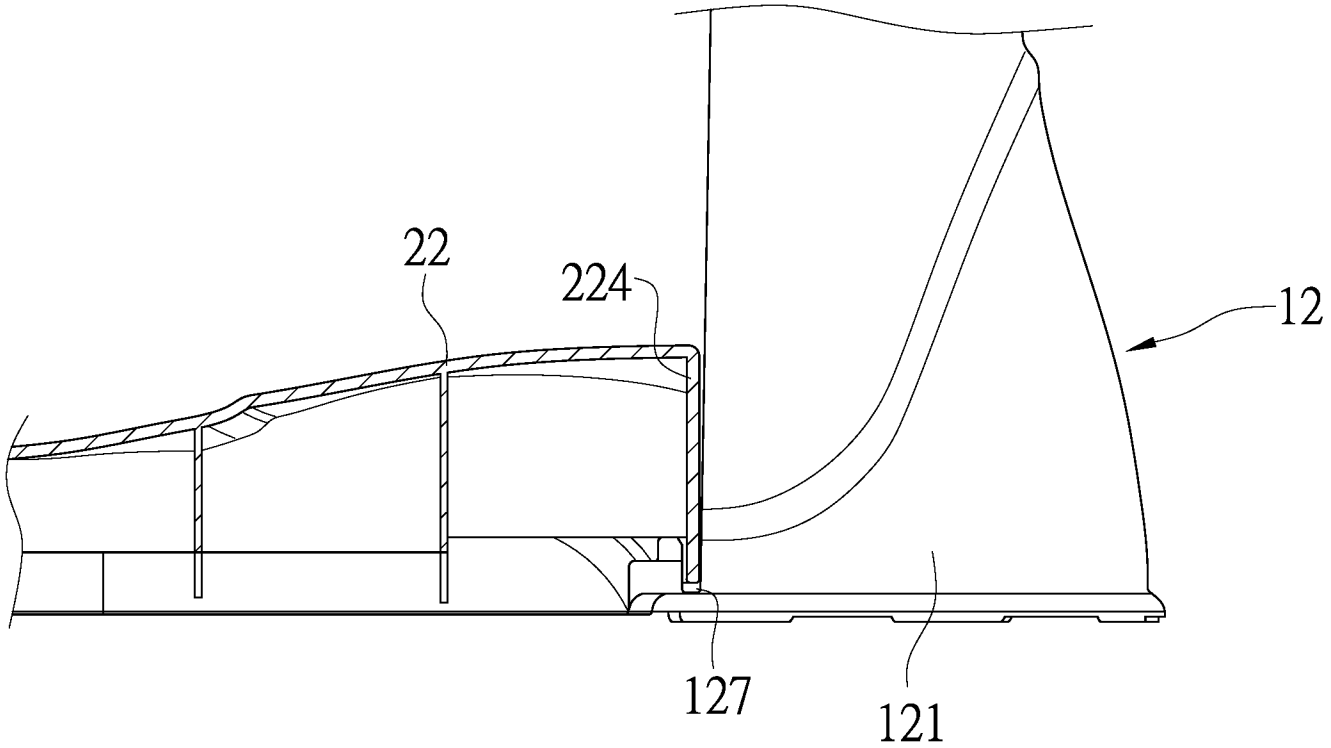
FIG. 9 is a partial cross-sectional view showing a chair leg assembled to a table leg.
Figure 10:
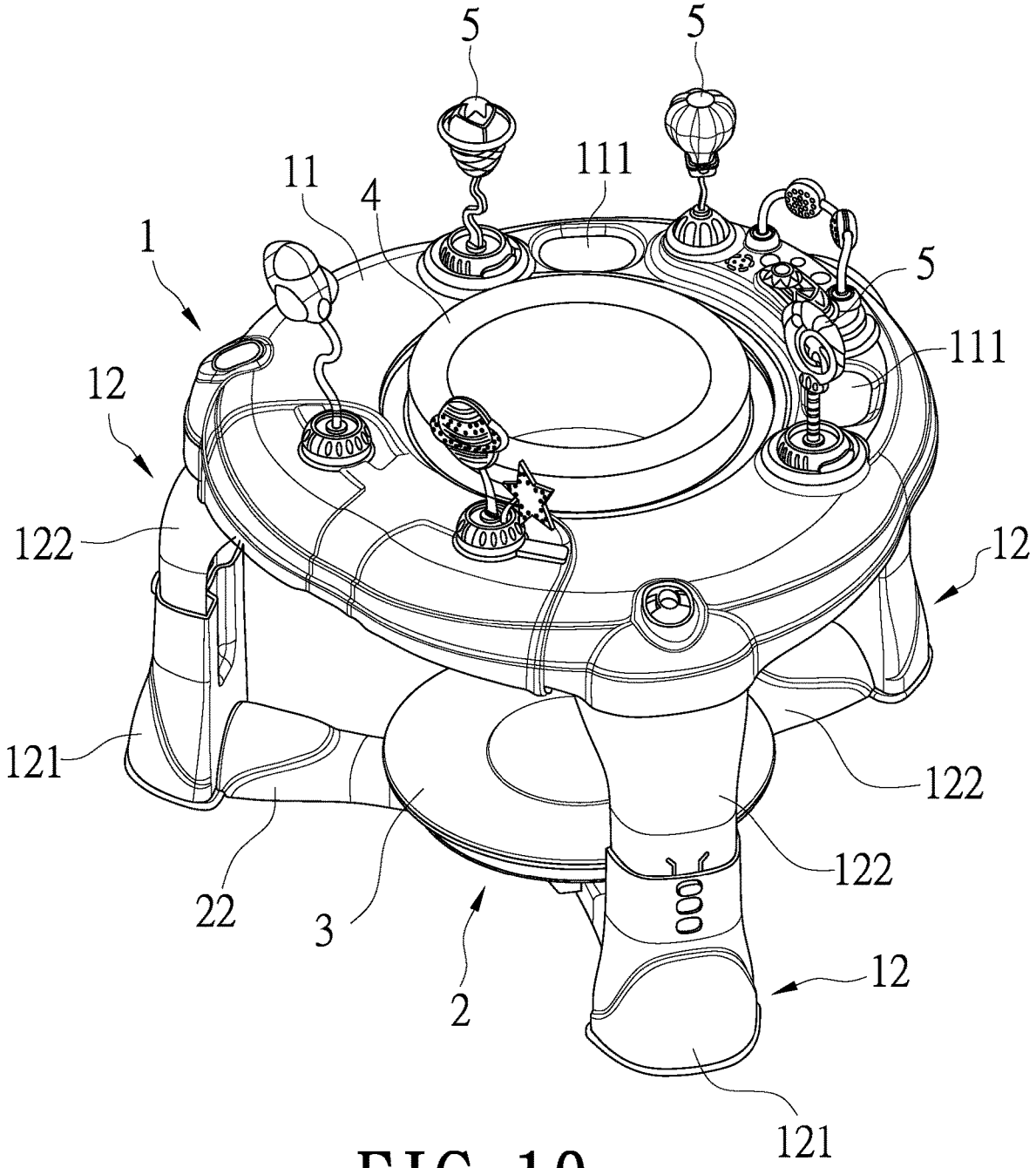
FIG. 10 is a stereogram showing a game table assembled to a seat.

Referring to FIG. 1, FIG. 2 and FIG. 7, an embodiment of a game furniture comprises a game table (1), a seat (2), a detachable cover plate (3), a detachable frame (4) and a plurality of toys (5).

The game table (1) is provided with a table board (11), a plurality of table legs (12) fixedly connected at a bottom of the table board (11) and a through hole (13) at a center of the table board (11) for accommodating a user. Each of the plurality of table legs (12) is provided with an upper part (122) for connecting the table board (11) and a lower part (121) connected at a lower end of the upper part (122) for move up and down relative to the upper part (122) to adjust a height of the table board (11). Furthermore, each of the plurality of table legs (12) is provided with a projection (126) at the upper part (122), a receiving slot (123) defined by an annular wall (124) at the lower part (121) for insertion of the upper part (122), a plurality of concave holes (125) arranged longitudinally on the annular wall (124) for engaging with the projection (126) to adjust the height of the table board (11). A lower end of the lower part (121) of each of the plurality of table legs (12) is further provided with an engaging slot (127). The table board (11) is further provided with a plurality of accommodating slots (111) for placing the plurality of toys (5). It is worth mentioning that the connection between the upper part (122) and the lower part (121) is not limited to the structure of a protruded part correspondingly inserting to a concave part. Similar techniques, e.g. two matching slide rails and the like, can also be used. The fixed structure is not limited to the cooperation of the projection (126) and the concave holes (125). The fixation purpose can also be achieved by means of screw bolts and plugs.

Referring to FIG. 3, FIG. 4, FIG. 5 and FIG. 6, the seat (2) is provided with a chair plate unit (21) and a plurality of chair legs (22) pivotally connected to the chair plate unit (21). The chair plate unit (21) is further provided with a chair plate (211), an elastic device (23), a plurality of hinge devices (212) disposed at a bottom of the chair plate (211), and an annular groove (216) at a top of the chair plate (211). The elastic device (23) is provided with a top board (231) for closing the annular groove (216) and moving up and down relative to the chair plate (211), and a plurality of elastic members (232) disposed in the annular groove (216) for connecting and putting against the top board (231). Each of the plurality of hinge devices (212) is provided with two pivots (213) disposed at the bottom of the chair plate (211), and a fixation trough (214) recessed at the bottom of the chair plate (211) for positioning and engaging with the plurality of chair legs (22). Each of the plurality of chair legs (22) is provided with two pivot holes (221) at two opposite sides thereof for respectively pivotally connecting the two pivots (213) of each of the plurality of hinge devices (212), and an engaging board (224) for correspondingly engaging with the engaging slot (127). Each of the two pivot holes (221) has a first zone (222) at a first end thereof and a second zone (223) at a second end opposite to the first end. Each of the plurality of chair legs (22) is pivoted relative to the two pivots (213) to move in the first zone (222) and the second zone (223) of each of the two pivot holes (221). When the two pivots (213) are located at the first zone (222) and each of the plurality of chair legs (22) is fixed on the fixation trough (214) of each of the plurality of hinge devices (212), each of the plurality of chair legs (22) cannot pivotally swing relative to the chair plate (211). When the two pivots (213) are located at the second zone (223) and each of the plurality of chair legs (22) is detached from each of the fixation trough (214) of each of the plurality of hinge devices (212), each of the plurality of chair legs (22) can pivotally swing relative to the chair plate (211) by the two pivots (213), so the plurality of chair legs (22) can be erected perpendicular to the chair plate unit (21) to stand on the ground or spread out to parallel to the chair plate unit (21) to decrease a height of the chair plate unit (21).

Referring to FIG. 1, FIG. 2 and FIG. 7, the detachable cover plate (3) is used for closing the through hole (13) further provided with an inserting block (31) at a bottom center thereof and a convex rib (32) for contacting the top board (231). The inserting block (31) is inserted into a plug hole (215) disposed at a center of the chair plate (211) to fix the detachable cover plate (3) on the chair plate (211) for the user to step thereon. The detachable frame (4) is disposed on the through hole (13) and further provided with an annular main body (41) sleeved with a seat cloth (42) for the user to sit thereon, and a storage basket (43) sleeved on the annular main body (41). A bottom of the seat cloth (42) is provided with two perforations (421) through which the user's legs can pass.

Referring to FIG. 1 and FIG. 2, in use of the present invention, when the plurality of chair legs (22) are erected on the floor, the child can sit on the seat (2) (not shown in the figures). The annular main body (41) is sleeved with the storage basket (43) and assembled to the through hole (13) from the bottom of the table board (11). A storage space (44) defined by the annular main body (41) and the storage basket (43) can be used for accommodating the plurality of toys (5). After the detachable cover plate (3) is fixed on the through hole (13) to close the through hole (13) and make the surface of the table board (11) flat, a group of the seat (2) and the game table (1) separated from the seat (2) can provide the child to use while reading or playing.

Figure 11:
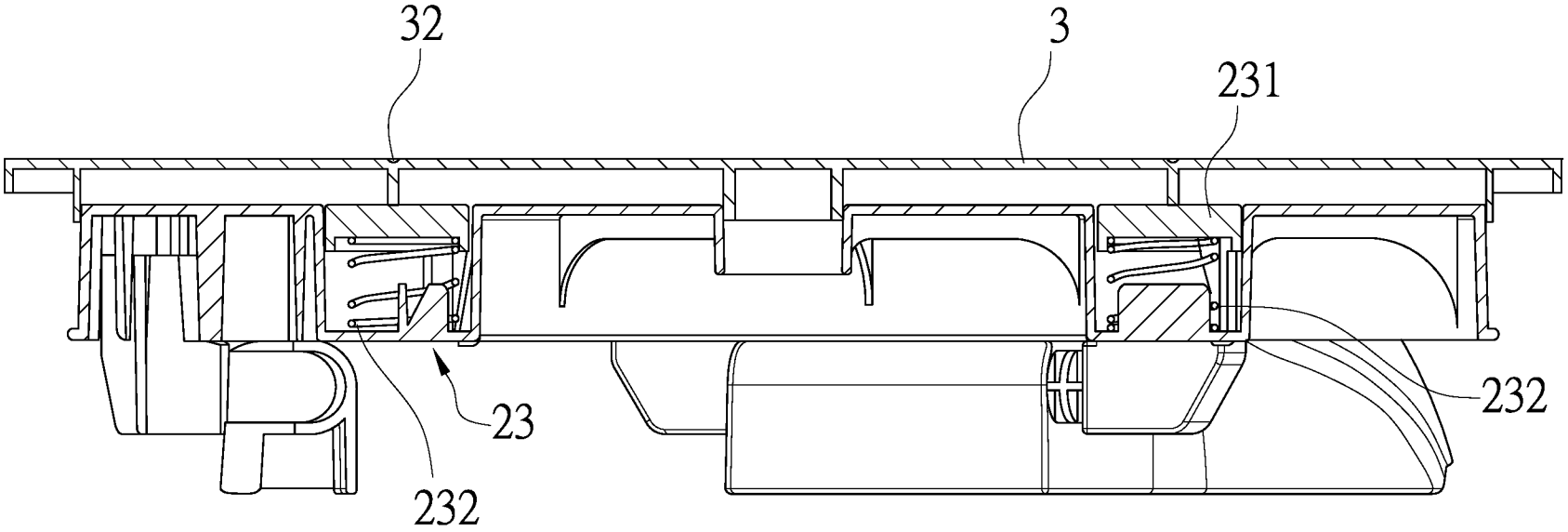
FIG. 11 is a partial cross-sectional view showing an elastic device assembled to a detachable cover plate.

Referring to FIG. 7 to FIG. 10, after the plurality of chair legs (22) are spread out to parallel to the chair plate unit (21), the detachable cover plate (3) is assembled on the chair plate (211), and the engaging board (224) of each of the plurality of chair legs (22) is correspondingly engaged with the engaging slot (127) of each of the plurality of table legs (12). The storage basket (43) of the detachable frame (4) is detached from the annular main body (41). Then, the annular main body (41) is turned upside down to assembled to the seat cloth (42), and the annular main body (41) sleeved with the seat cloth (42) are further assembled to the through hole (13) from the top of the table board (11). An accommodating space (45) is formed and defined by the annular main body (41) and the seat cloth (42) to store objects. In such a case, a toddler (not shown in the figures) can sit in the detachable frame (4) and respectively pass the legs through the two perforations (421) to step on the detachable cover plate (3) so as to prevent the toddler's feet from contacting the ground and moving arbitrarily. Accordingly, the present invention can restraint babies in a specific range. Referring to FIG. 11, when the toddler steps on the detachable cover plate (3), the convex rib (32) squeezes the top board (231) and compresses the plurality of elastic members (232), so the plurality of elastic members (232) will rebound to assist the toddle to jump on the detachable frame (4), which increases the fun of the game furniture of the present invention. It is worth mentioning that the connection between each of the plurality of chair legs (22) and each of the plurality of table legs (12) is not limited to the type of engagement. The connection purpose can also be achieved by means of lock holes and corresponding screws or nuts.

Accordingly, compared with the technique available now, the present invention has multiple functions in use by changing the chair legs to be spread out to parallel to the chair plate unit or to be erected perpendicular to the chair plate unit. The present invention can act as not only a game seat for accommodating an infant or a toddler for protection, but also as a separate table and chair for the child to use while reading or playing.

What is claimed is:

1. A game furniture comprising:

a game table having a table board, a plurality of table legs fixedly connected at a bottom of the table board and a through hole at a center of the table board for accommodating a user; and a seat having a chair plate unit and a plurality of chair legs pivotally connected to the chair plate unit, wherein the chair plate unit is provided with a chair plate, a plurality of hinge devices disposed at a bottom of the chair plate, two pivots disposed at the bottom of each of the plurality of hinge devices, and a fixation trough recessed at the bottom of each of the plurality of hinge devices for positioning and engaging with the plurality of chair legs, wherein each of the plurality of chair legs is provided with two pivot holes at two opposite sides thereof for respectively pivotally connecting the two pivots of each of the plurality of hinge devices to be pivoted relative to the two pivots in a first zone and a second zone respectively at a first end and a second end opposite to the first end of each of the two pivot holes, wherein each of the plurality of chair legs is fixed on the fixation trough of each of the plurality of hinge devices when the two pivots are located at the first zone or detached from the fixation trough of each of the plurality of hinge devices and pivoted to swing relative to the chair plate by the two pivots when the two pivots are located at the second zone, and wherein the plurality of chair legs are respectively engaged with the plurality of table legs when the plurality of chair legs are spread out to parallel to the chair plate unit to decrease a height of the chair plate unit, and wherein the seat is separated from the game table for use when the plurality of chair legs are erected perpendicular to the chair plate unit.

2. The game furniture as claimed in claim 1, wherein each of the plurality of table legs is provided with an upper part for connecting the table board and a lower part connected at a lower end of the upper part for moving up and down relative to the upper part to adjust a height of the table board.

3. The game furniture as claimed in claim 2, wherein each of the plurality of table legs is further provided with a projection at the upper part, a receiving slot defined by an annular wall at the lower part for insertion of the upper part, a plurality of concave holes arranged longitudinally on the annular wall for engaging with the projection to adjust the height of the table board.

4. The game furniture as claimed in claim 3, wherein the lower part is further provided with an engaging slot at a lower end thereof, and wherein each of the plurality of chair legs is provided with an engaging board for correspondingly engaging with the engaging slot.

5. The game furniture as claimed in claim 1, further comprising a detachable cover plate for closing the through hole.

6. The game furniture as claimed in claim 5, wherein the chair plate is further provided with a plug hole at a center thereof, and wherein the detachable cover plate is further provided with an inserting block at a bottom center thereof for inserting into the plug hole to fix the detachable cover plate on the chair plate for the user to step thereon.

7. The game furniture as claimed in claim 6, wherein the chair plate unit is further provided with an annular groove at a top of the chair plate, and an elastic device having a top board for closing the annular groove and moving up and down relative to the chair plate and a plurality of elastic members disposed in the annular groove for engaging against the top board, and wherein the detachable cover plate is further provided with a convex rib for contacting the top board.

8. The game furniture as claimed in claim 7, further comprising a detachable frame adapted to be disposed on the through hole from a top of the table board and having an annular main body sleeved with a seat cloth for the user to sit thereon, an accommodating space defined by the annular main body and the seat cloth, and two perforations at a bottom of the seat cloth for the user's legs to pass therethrough.

9. The game furniture as claimed in claim 8, further comprising a plurality of toys and a plurality of accommodating slots on the table board for placing the plurality of toys.

10. The game furniture as claimed in claim 9, wherein the detachable frame is adapted to be disposed on the through hole from a bottom of the table board, and is further provided with a storage basket sleeved on the annular main body and a storage space defined by the annular main body and the storage basket for accommodating the plurality of toys.

* * * * *